United States Patent [19]

Gardiner et al.

[11] Patent Number: 4,509,054

[45] Date of Patent: Apr. 2, 1985

[54] ANTI-STALLING ROTATING ANTENNA BUOY SYSTEM USING WIND DEFLECTING PLATES

[75] Inventors: George K. Gardiner; Dean E. Norris, both of Scottsdale, Ariz.

[73] Assignee: Motorola, Inc., Schaumburg, Ill.

[21] Appl. No.: 446,735

[22] Filed: Dec. 3, 1982

[51] Int. Cl.[3] ..... H01Q 1/34

[52] U.S. Cl. ..... 343/709; 343/DIG. 1

[58] Field of Search ..... 343/709, 710, DIG. 1

[56] References Cited

U.S. PATENT DOCUMENTS 2,697,828 12/1954 Heintz ..... 343/DIG. 1

3,276,024 9/1966 Stevens ..... 343/DIG. 1

*Primary Examiner*—Eli Lieberman

*Attorney, Agent, or Firm*—Lowell W. Gresham

[57] ABSTRACT

A plurality of plates are rigidly affixed normal to forward and rearward surfaces along a major axis of a maximal diameter of an asymmetrical rotating antenna. In the presence of a wind, any aerodynamic forces tending to produce aerodynamic rotational moments on the antenna are reduced by the interaction between the wind, which produces a boundary layer on the antenna, and the plates, which affect the boundary layer.

The net effects of the plates are to reduce the aerodynamic pressure difference between the forward and rearward surfaces of the antenna and to move the center of aerodynamic pressure closer to the center of rotation of the antenna. Due to these effects, the overall aerodynamic rotational movement on the antenna is reduced.

17 Claims, 2 Drawing Figures

ANTI-STALLING ROTATING ANTENNA BUOY SYSTEM USING WIND DEFLECTING PLATES

BACKGROUND OF THE INVENTION

The present invention pertains in general to anti-stalling systems and methods therefor for use with asymmetric, motor driven structures in the presence of wind pressure, and in particular to anti-stalling, rotating antenna buoy systems and methods therefor.

As a rotating antenna rotates in the presence of a directed movement of air, such as a wind, the wind exerts aerodynamic forces on the antenna. An asymmetrical rotating antenna is a rotating antenna for which the aerodynamic center of pressure of the antenna is different from the center of rotation of the antenna so that the antenna is subject to torsonal aerodynamic moments. Aerodynamic forces exerted by the wind on an asymmetrical antenna mounted on a mast can cause a rotational moment around the antenna mast that alternately helps or hinders the motion of the antenna as it rotates respectively into or away from the wind.

Placing a lage asymmetrical rotating antenna, such as a radar antenna, on a mast driven by a motor located within a small, streamlined buoy floating on water creates an additional problem. There is more resistance to rotation of the antenna in the wind than there is resistance to rotation of the buoy in the water. Therefore, it is the tendency of an asymmetrical rotating antenna which is erected on a buoy to remain stalled so that it presents the least amount of surface area to the wind while the buoy is driven to counter-rotate by the action of the motor therein.

A combined problem of a variable torque load applied to the motor because of alternately helpful or hindering wind moments and a counter rotational tendency on the part of the buoy make the implementation of a rotating antenna buoy system particularly difficult. The complexity, bulkiness and expense of such a system is increased by the need for rotational speed regulation equipment and a motor sufficiently large to overcome the peak values of the wind-induced moments.

One approach to compensating for wind effects on rotating antennas is to provide an over-all assisting torque to offset the wind-induced moments. This approach involves the use of a plurality of cups attached to one side an antenna or to some portion of an antenna supporting structure and oriented at angles so that the cups receive a greater force from the wind during one portion of a revolution than the remaining portion in order to aid rotation. Despite the beneficial effect on the varying torque load in the presence of the wind, this approach does not prevent the counter rotational problem present in rotating antenna buoy systems. Furthermore, such an approach is directed toward presenting a countervailing force at portions of the rotational cycle when wind-induced moments are greatest and not at reducing or distributing aerodynamic forces along the antenna. Thus, undesirable strain may result from the contest between the wind forces and the countervailing force. Furthermore, such a countervailing force approach does not lend itself well to cooperation with other anti-stalling devices except by increasing the complexity of the overall design.

SUMMARY OF THE INVENTION

It is an object of the present invention to provide a new and improved anti-stalling, rotating antenna buoy system for use in the presence of a directed movement of air capable of inducing a rotational moment on a rotating antenna.

It is a further object of the present invention to provide a new and improved rotating antenna system capable of redistributing wind pressure within the system to reduce rotational moments applied by the wind.

Another object of the present invention is to provide a new and improved method for reducing an aerodynamic moment on a rotating antenna.

Among the advantages of the present invention are lower complexity, bulkiness and cost than existing systems. A further advantage of the present invention is the ability to cooperate with other means for reducing wind pressure forces on rotating antennas.

In order to attain the above-mentioned and other objects and advantages the apparatus according to the present invention involves an anti-stalling, rotating antenna buoy system, for use in the presence of a directed movement of air capable of inducing a rotational moment on a rotating antenna. The system comprises a rotating antenna having a major axis between a first side of the first length and a second side of a second length. The rotating antenna is rotatably coupled to a buoy. First means for distributing pressure of the directed movement of air are affixed to the first side and second means for distributing pressure of the directed movement of air are affixed to the second side so that by the action of the first and second means the moment on the rotating antenna due to the directed movement of air is reduced.

The method according to the present invention involves reducing an aerodynamic moment on a rotating antenna. The method comprises the steps of providing a rotating antenna, having a major axis with a first side having a first length and with a second side having a second length and having a plurality of plates, and affixing said plurality of plates normal to said first and to said second sides of said major axis of said rotating antenna.

DESCRIPTION OF THE PREFERRED EMBODIMENT

Figure 1:
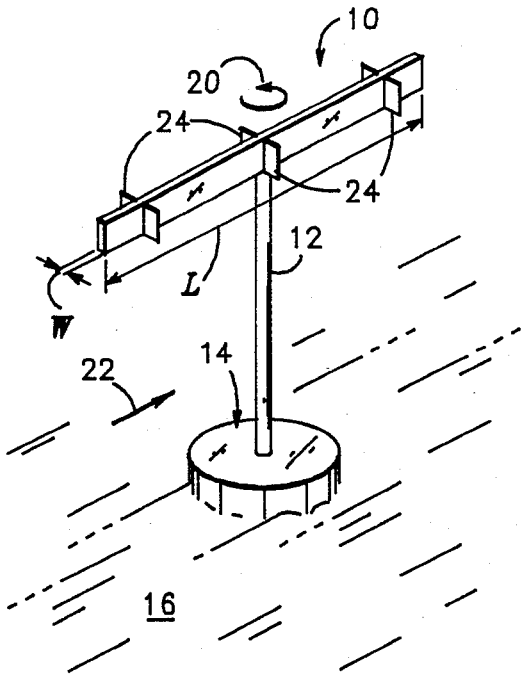
FIG. 1 is a perspective view of a preferred embodiment of the present invention.

In a preferred embodiment of the anti-stalling, rotating antenna buoy system according to the present invention, as shown in FIG. 1 a long, narrow, rectangular prismatic antenna 10, having a long dimension, L, and a narrow dimension, W, is fixed to a cylindrical shaft 12 which is connected to a motor (not shown) within an aerodynamically symmetrical buoy 14. Buoy 14 is floating on the surface of water 16.

The motor within buoy 14 applies torque to shaft 12 causing antenna 10 to have a tendency to rotate in a counterclockwise direction 20. However, the interaction between a directed movement of air, such as a wind 22, and antenna 10 causes a rotational aerodynamic torque on antenna 10 that alternately helps and hinders rotation of antenna 10 when antenna 10 rotates away from and into the wind respectively.

Because there is more resistance to rotation of antenna 10 in the wind than there is resistance to rotation of buoy 14 in the water, antenna 10 tends to remain aligned with long dimension L parallel to the direction of wind 22 while buoy 14 counter rotates in a clockwise direction. To reduce the aerodynamic torque applied by the wind to the antenna, a plurality of rectangular plates 24 are affixed to antenna 10.

Figure 2:
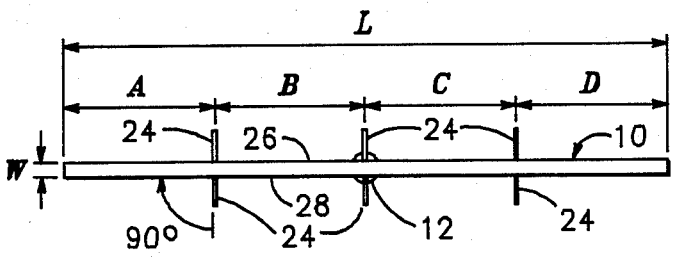
FIG. 2 is a view in top plan of the antenna portion of FIG. 1.

As shown in FIG. 2, plates 24 are affixed normal to a first surface 26 and to a second surface 28 of antenna 10. A first plate is located a distance A from a first end of antenna 10, a second plate is located a distance B from the first plate, and a third plate is located a distance C from the second plate and a distance D from a second end of antenna 10. A fourth plate is located on second surface 28 at a distance A from the first end, and a fifth plate is located a distance B from the first plate. A sixth plate is located a distance C from the fourth plate and a distance D from the second end of antenna 10. Thus, as in FIG. 2 where A=B=C=D, the plates are located at 25%, 50% and 75% of the length of the antenna on each of the two sides along length L.

Plates 24 serve two aerodynamic purposes. First, when antenna 10 is oriented at some angle of rotation relative to wind direction 22, the plates on side 28, that is on the "back" of the antenna relative to its direction of rotation, would tend to significantly increase the pressure on the back of the antenna, thus decreasing the net pressure force on the antenna due to the difference between front and back pressure. The plates on side 26, that is the "front" side of the antenna relative to its direction of rotation, will also increase pressures on various parts of the front surface of the antenna close to the plates but the total effect on pressure on front side 26 will be less than on rear side 28. Thus, there will be a net decrease in normal or net pressure force on the antenna due to wind 22 because of the presence of plates 24 on both surfaces of the antenna. Second, the plates will tend to move the center of pressure on the antenna 10 more toward the center of antenna 10 by providing pressure peaks all along the antenna. In an antenna without plates 24, the pressure along the antenna axis due to wind forces peaks fairly close to the leading edge, then decreases along the axis of the antenna. Plates 24 produce pressure peaks at the plate locations. These peaks tend to equalize the pressure along the antenna axis and move the center of pressure toward the center of the antenna.

As is obvious to one skilled in the art, plates 24 may be of any material that is sufficiently rigid to modify a boundary layer on antenna 10 caused by the interaction of wind 22 and antenna 10.

For a rotating antenna system wherein antenna 10 is considered to be a flat plate with an aspect ratio of 0.075, for plates located at 25%, 50% and 75% of length L of antenna 10, and for square plates of about two inches on a side, a maximum normal force for a 30 knot wind has been calculated to be 26.6 pounds force and a maximum rotational moment has been calculated to be 46.5 foot pounds. A calculated normal force coefficient of about 0.897, a center of pressure in percent of axis of 24.3, and a rotational moment coefficient of 0.14 for the same embodiment represent an improvement over respective values calculated for the same antenna without plates 24 of 1.10, 27.4 and 0.25 respectively. The calculated decrease in rotational moment due to the use of the plates is 44% at a typical rotational angle of 40 degrees. General calculations show that plates 24 should decrease the rotational moment on an antenna by a factor of 1.5 to 2.0.

While the present invention has been described in terms of a preferred embodiment, further modifications and improvements will occur to those skilled in the art. For example, although an embodiment having six plates has been described above, an optimum number of plates may vary depending upon the application. Too many plates may be counterproductive due to growth of a boundary layer in the spaces between the plates which may mask effectiveness of the plates. As another example, the present invention may be utilized to advantage in combination with means for preventing rotation of buoys or may even be utilized on land-based antennas.

Furthermore, antenna 10 need not be a rectangular prism so that surfaces 26 and 28 may be of different length. Also, plates 24 need not be flat or permanently deployed. Plates 24 may be curved and may be attached so that they are deployed by popping up in the presence of wind.

We desire it to be understood, therefore, that this invention is not limited to the particular form shown and that we intend in the appended claims to cover all such equivalent variations which come within the scope of the invention as described.

We claim:

1. An anti-stalling, rotating antenna buoy system, for use in the presence of a directed movement of air capable of inducing a rotational moment on a rotating antenna, comprising:

a buoy;

a rotating antenna having a first side with a first length, having a second side with a second length, having a major axis between said first side and said second side and being rotatably coupled to said buoy;

first means, affixed to said first side, for distributing pressure of the directed movement of air, and second means, affixed to said second side, for distributing pressure of the directed movement of air so that by the action of said first and said second means the rotational moment on the rotating antenna due to the directed movement of air is reduced.

2. The anti-stalling, rotating antenna buoy system as recited in claim 1 wherein said first means for distributing pressure comprises a first plurality of plates affixed normal to said first side and said second means for distributing pressure comprises a second plurality of plates affixed normal to said second side.

3. The anti-stalling, rotating antenna buoy system as recited in claim 2 wherein said first plurality of plates comprises a first plate affixed at 25% of said first length, a second plate affixed at 50% of said first length, and a third plate affixed at 75% of said first length.

4. The anti-stalling, rotating antenna buoy system as recited in claim 2 wherein said second plurality of plates comprises a fourth plate affixed at 25% of said length, a fifth plate affixed at 50% of said length and a sixth plate affixed at 75% of said length.

5. The anti-stalling, rotating antenna buoy system as recited in claim 2 wherein said first plurality of plates comprises a first plate affixed at 25% of said first length, a second plate affixed at 50% of said first length and a third plate affixed at 75% of said first length and wherein said second plurality of plates comprises a fourth plate affixed at 25% of said second length, a fifth plate affixed at 50% of said second length and a sixth plate affixed at 75% of said second length.

6. A rotating antenna system comprising:

an asymmetrical rotating antenna having a maximal diameter, said antenna being extended along the maximal diameter to provide a forward surface having a forward length, the forward surface for facing into a directed movement of air, and to provide a rearward surface having a rearward length, the rearward surface for facing away from the directed movement of air;

first means, affixed to said forward surface, for distributing pressure due to the directed movement of air, the distribution being between the forward and rearward surfaces; and second means, affixed to said rearward surface, for distributing pressure due to the directed movement of air, the distribution being between the forward and rearward surfaces so that the combined effect of said first and said second means is to reduce a rotational moment on said rotating antenna due to the directed movement of air.

7. The rotating antenna system as recited in claim 6 wherein said forward length equals said rearward length.

8. The rotating antenna system as recited in claim 7 wherein said first means for distributing pressure comprise a first plurality of plates affixed normal to said forward surface and said second means for distributing pressure comprises a second plurality of plates affixed normal to said rearward surface.

9. The rotating antenna system as recited in claim 8 wherein said first plurality of plates comprises a first plate affixed at 25% of said forward length, a second plate affixed at 50% of said forward length and a third plate affixed at 75% of said forward length.

10. The rotating antenna system as recited in claim 8 wherein said second plurality of plates comprises a fourth plate affixed at 25% of said rearward length, a fifth plate affixed at 50% of said rearward length and a sixth plate affixed at 75% of said rearward length.

11. The rotating antenna system as recited in claim 8 wherein said first plurality of plates comprises a first plate affixed at 25% of said forward length, a second plate affixed at 50% of said forward length and a third plate affixed at 75% of said forward length and wherein said second plurality of plates comprises a fourth plate affixed at 25% of said rearward length, a fifth plate affixed at 50% of said rearward length and a sixth plate affixed at 75% of said rearward length.

12. The rotating antenna system as recited in claim 7 wherein said forward length does not equal said rearward length.

13. The rotating antenna system as recited in claim 12 wherein said first plurality of plates comprises a first plate affixed at 25% of said forward length, a second plate affixed at 50% of said forward length and a third plate affixed at 75% of said forward length.

14. The rotating antenna system as recited in claim 12 wherein said second plurality of plates comprises a fourth plate affixed at 25% of said rearward length, a fifth plate affixed at 50% of said rearward length and a sixth plate affixed at 75% of said rearward length.

15. The rotating antenna system as recited in claim 12 wherein said first plurality of plates comprises a first plate affixed at 25% of said forward length, a second plate affixed at 50% of said forward length and a third plate affixed at 75% of said forward length and wherein said second plurality of plates comprises a fourth plate affixed at 25% of said rearward length, a fifth plate affixed at 50% of said rearward length and a sixth plate affixed at 75% of said rearward length.

16. A method for reducing an aerodynamic moment on a rotating antenna comprising the steps of providing a rotating antenna having a major axis with a first side having a first length and with a second side having a second length, and having a plurality of plates;

affixing said plurality of plates normal to said first and to said second sides of said major axis of said rotating antenna.

17. The method according to claim 16 wherein said affixing step comprises the first step of attaching a first plate at 25% of said first length, a second plate at 50% of said first length and a third plate at 75% of said first length and a second step of attaching a fourth plate at 25% of said second length, a fifth plate at 50% of said second length and a sixth plate at 75% of said second length.

* * * * *